US007349640B2

(12) United States Patent
Bartley et al.

(10) Patent No.: US 7,349,640 B2
(45) Date of Patent: Mar. 25, 2008

(54) IMAGE OFFSET PREVENTION ON PLASTIC SUBSTRATE MEDIA

(75) Inventors: Brian Keith Bartley, Burgin, KY (US); Larry Christopher Coleman, Lexington, KY (US); Kevin Dean Schoedinger, Lexington, KY (US); Johnny Ray Sears, Midway, KY (US)

(73) Assignee: Lexmark International, Inc., Lexington, KY (US)

( * ) Notice: Subject to any disclaimer, the term of this patent is extended or adjusted under 35 U.S.C. 154(b) by 41 days.

(21) Appl. No.: 11/007,724

(22) Filed: Dec. 7, 2004

(65) Prior Publication Data

US 2006/0120738 A1 Jun. 8, 2006

(51) Int. Cl.
*G03G 15/00* (2006.01)

(52) U.S. Cl. ..... 399/45

(58) Field of Classification Search ..... 399/45
See application file for complete search history.

(56) References Cited

U.S. PATENT DOCUMENTS

| | | | | |
|---|---|---|---|---|
| 4,006,982 | A | 2/1977 | Squassoni et al. | |
| 4,390,872 | A * | 6/1983 | Murakami et al. | 399/9 |
| 5,321,481 | A | 6/1994 | Mathers | |
| 5,697,015 | A | 12/1997 | Ream et al. | |
| 5,741,572 | A | 4/1998 | Heeg et al. | |
| 5,786,571 | A | 7/1998 | Bethel et al. | |
| 5,809,367 | A | 9/1998 | Yoo et al. | |
| 5,857,131 | A | 1/1999 | Hasegawa | |
| 5,968,634 | A * | 10/1999 | Heeg et al. | 428/32.39 |
| 6,157,793 | A | 12/2000 | Weaver et al. | |
| 6,160,975 | A | 12/2000 | Bartley et al. | |
| 6,163,662 | A * | 12/2000 | Martin et al. | 399/45 |
| 6,185,389 | B1 | 2/2001 | Bartley et al. | |
| 6,285,838 | B1 | 9/2001 | Able et al. | |
| 6,308,021 | B1 | 10/2001 | Isogai et al. | |
| 6,482,510 | B1 * | 11/2002 | Rajan et al. | 428/349 |
| 6,512,597 | B1 | 1/2003 | Cooper et al. | |
| 6,606,462 | B2 | 8/2003 | Siegel et al. | |
| 6,628,916 | B2 * | 9/2003 | Yasui et al. | 399/329 |
| 6,720,064 | B2 | 4/2004 | Goto | |
| 6,788,905 | B2 * | 9/2004 | Tsutada | 399/45 |
| 6,804,477 | B2 * | 10/2004 | Maruyama | 399/45 |
| 2005/0008381 | A1 * | 1/2005 | Aono et al. | 399/45 |
| 2006/0008286 | A1 * | 1/2006 | Nihonyanagi et al. | 399/69 |

OTHER PUBLICATIONS

English abstract of JP 2001-013816 A.*

* cited by examiner

*Primary Examiner*—David M. Gray
*Assistant Examiner*—Ruth N LaBombard
(74) *Attorney, Agent, or Firm*—Grossman, Tucker, Ferreault & Pfleger, PLLC

(57) ABSTRACT

A system and method that controls the amount of energy accumulated at the collection location of a printing device to prevent image transfer or offsetting between sheets of stacked media, in particular, media of high thermal capacitance. This may be accomplished by regulating one or more of a combination of factors, including media process speed and sheet interval or pause time, while providing adequate fusing of the toner and an efficient printing operation.

12 Claims, 6 Drawing Sheets

IMAGE OFFSET PREVENTION ON PLASTIC SUBSTRATE MEDIA

FIELD OF THE INVENTION

The present invention relates to a system and method of preventing image transfer or "offsetting" between sheets of media such as plastic substrate or similar unconventional media with a layer of plastic on the outer surface such as transparencies or labels, in the output bin of a printing device. More particularly, the present invention relates to a system and method of limiting the amount and rate of energy accumulation in a stack of media by allowing more cooling time in the output bin of a printing device by controlling a combination of factors, which may include fuser temperature, media process speed and interval time between copies. This provides a lower temperature of the media stack as a whole and/or lower temperatures between the interface of, e.g., two transparencies as they are stacked. The lower temperature achieved may therefore be, e.g., below that temperature in which bonding can occur between media, e.g. plastic films on the backside of one transparency and the printer toner on the frontside of another transparency.

BACKGROUND OF THE INVENTION

Image forming apparatus and devices such as a copying machine, a printer or a facsimile machine may use an electrophotographic system to heat and fuse a developer image that has been transferred from an image bearing body to a sheet of media, such as paper or a transparency resin sheet, and "fix" the image to a surface of the sheet. The transferring body may comprise nip rolls or a belt assembly. These devices preferably operate at high speeds to produce multiple copies rapidly. In doing so, a significant amount of heat energy is transferred to the sheet media as the fuser for the toner being transferred may operate in the range of about 130° C. to about 220° C. depending on the media transit speed and the nature of toner being transferred. The result is an accumulation of heat energy in the output bin of the apparatus as the media sheets are stacked.

With transparency media, which may be comprised of one or more layers of thermoplastic in sheet form, more heat is absorbed than plain paper. The higher thermal capacitance of transparencies may: (a) allow more energy to be "piled" into a stack of transparencies in the output bin; and/or (b) make an abnormally high temperature interface even between only two transparencies printed.

A problem in image quality may arise as multiple transparencies stack up in the printer output bin, as the heat from the fuser process accumulates and may cause the transferred toner to become "sticky" and adhere somewhat to the backside of the previous transparency which it rests against in the stack. Also, with the high thermal capacitance of transparencies even two sheets printed alone may be very hot when touching each other in the output bin. This may result in a residual image (offset) that appears on the backside of the earlier-copied sheet and/or voided areas in the toner image printed on the front side of the more recently copied sheet.

What is therefore needed is a process and a system that can adjust media variables such as process speed and fuser temperature to limit the rate of energy accumulated and allow more cooling time in a stack of media, e.g. transparencies, to below an energy/temperature threshold level and which will provide adequate fusing of the toner yet substantially prevent residual image transfer or "offsetting".

What is also needed is a control algorithm which upon recognition of the type of media being processed initiates a process protocol to effectively control the accumulation of heat in the output bin or other collection location or will allow sufficient time or pause between as little as two media sheets, e.g. transparencies, such that a targeted interface temperature is not exceeded and bonding between the plastic film and toner does not occur in the stack.

It is thus an object of the present invention to provide a system and method of limiting the amount of media energy accumulated, or pausing sufficiently (e.g., increase in inter-page gaps or even slow down of the rate of media transport) to allow cooling between the sheet-to-sheet interface of 2 or more media sheets in a stack output bin of a printer or like device.

It is a further object of the present invention to provide a control algorithm for controlling the heat accumulated in a stack of printed transparencies below a critical threshold level such that offsetting is substantially prevented.

It is further object of the present invention to provide a system and a method to reduce the rate of energy accumulated in a stack, or allow more time between even two printed sheets such as printed transparencies by, among other things, reducing the process speed of the media moving through the printing apparatus optionally in concert with reducing the fuser temperature when, e.g., transparencies are printed, to provide more cooling time yet still provide adequate fusing of the toner.

It is a still further object of the present invention to include an interval or pause time in the printing sequence as another technique of adjusting media throughput to prevent accumulation of energy in the output bin from exceeding a critical threshold value and to allow the energy accumulated in the output bin to dissipate.

These and further objects, features and advantages of the present invention will become apparent from the following description when taken in connection with the accompanying drawings which, for purposes of illustration only, show an embodiment in accordance with the present invention.

SUMMARY OF THE INVENTION

The present invention is directed at a system and method of controlling print quality on media by controlling the amount of energy accumulated in the output bin or collection device of the printer device and substantially preventing "offsetting".

In one embodiment, the present invention relates to a method of controlling the accumulation of heat in stacked sheets of media in a printing or copying device, the device having a collection location for collection of a plurality of media sheets, wherein the sheets of media include toner images, and a fixing device to fix the toner images on said media at a selected temperature. The method includes the steps of providing in the printing or copying device a control system wherein the control system identifies media for printing or copying at a selected fuser temperature and adjusts the fuser temperature for selected media. The controller may then assign a rate of movement of media in the printing or copying device for selected media such that the accumulation of heat in a plurality of sheets of media is controlled not to exceed a condition where the toner on the plurality of sheets of media at the collection location will transfer as between said sheets.

In another embodiment, the present invention relates to a method of controlling the accumulation of heat in stacked sheets of media in a printing or copying device, the device having a collection location for collection of a plurality of media sheets and wherein the sheets of media include toner images, and a fixing device to fix said toner images on the media at a selected temperature. The method includes the steps of providing in the printing or copying device a control system wherein the control system identifies media for printing or copying at a selected fuser temperature and lowers said fuser temperature for selected media and sets a throughput rate based on said media type. The control system then may assign a rate of movement of media in the printing or copying device for selected media relative to the set throughput rate such that the accumulation of heat in a plurality of sheets of said media is controlled not to exceed a condition where said toner on the plurality of sheets of media at the collection location will transfer as between said sheets.

In another embodiment, the present invention relates to a method of controlling the accumulation of heat in stacked sheets of media in a printing or copying device, the device having a collection location for collection of a plurality of media sheets wherein the sheets of media include toner images. The method includes the steps of identifying a temperature where the toner on a plurality of sheets of media at the collection location will transfer as between the sheets and monitoring a temperature of said plurality of sheets at said collection location. The method then includes incorporating in the printing or copying device a control system wherein the control system assigns a rate of movement of media in the printing or copying device such that the accumulation of heat in a plurality of sheets of the media at the collection location is controlled not to exceed the temperature where the toner on said plurality of sheets of media will transfer as between said sheets.

In another embodiment, the present invention relates to a method of controlling the accumulation of heat in stacked sheets of media in a printing or copying device, the device having a collection location for collection of a plurality of media sheets, wherein the sheets of media include toner images, and a fixing device to fix toner images on the media at a selected temperature. The method includes the steps of providing in the printing or copying device a control system wherein said control system identifies media for printing or copying at a selected fuser temperature. The control system may then assign a rate of movement of media in the printing or copying device for selected media such that the accumulation of heat in a plurality of sheets of said media at the collection location is controlled not to exceed a condition where said toner on the sheets of media will transfer as between said sheets.

In another embodiment, the present invention relates to a system for controlling the accumulation of heat in a plurality of sheets of media in a printing or copying device, wherein the sheets of media include toner images, and a fixing device to fix the toner images on the media at a selected temperature. The device also has a collection location for collection of one or a plurality of media sheets. The device includes a controller which is capable of setting a throughput rate and fuser temperature for the media based upon the media type, and which controller identifies a maximum sheet count for the media. The controller is also capable of identifying whether or not the printer or copying device has output a number of media sheets equal to the maximum media sheet count, at which point the controller is capable of assigning a rate of movement of media in the printing or copying device for selected media. This assignment is such that the accumulation of heat in a plurality of sheets of media at the collection location is controlled not to exceed a condition where toner will substantially transfer as between the sheets.

DETAILED DESCRIPTION OF THE PREFERRED EMBODIMENT

Printing or copying an image onto a substrate such as high thermal capacitance media, such as a transparent resin sheet, is typically accomplished by fixing a loose powder toner using heat onto the surface of the media in an electrophotographic process. In electrophotography, a latent image is created on the surface of an insulating, photoconducting material by selectively exposing an area of the surface to light. A difference in electrostatic density is created between the areas on the surface exposed and those unexposed to the light. The latent electrostatic image is developed into a visible image by electrostatic toners which contain pigment components and thermoplastic components. The toners, which may be liquids or powders, are selectively attracted to the photoconductor's surface, and either exposed or unexposed to light, depending upon the relative electrostatic charges on the surfaces of the photoconductor, the development electrode and the toner. The photoconductor may be either positively or negatively charged, and the toner system similarly may contain negatively or positively charged particles.

A sheet of paper or intermediate transfer medium is given an electrostatic charge opposite that of the toner and then passed close to the photoconductor's surface, pulling the toner from the photoconductor's surface onto the paper or intermediate medium in the pattern of the image developed from the photoconductor's surface. A set of fuser rolls or belts, under heat, melts and fixes the toner to the paper or medium surface subsequent to transfer, producing the printed image.

After the image is transferred to the paper or other recording medium, it goes to the fuser where the medium is moved through a nip where it is heated and pressed. This melts the thermoplastic portion of the toner, causing it to bond to the medium, thereby fixing the image onto the surface.

The process of fixing the image therefore involves coalescing and binding the toner image to a plastic or paper substrate or other media. For transparencies, the plastic substrate may be a polyester, polyamide, ionomer or other resin, or combinations or laminates thereof. In the case of labels, the labels may comprise a paper or plastic substrate with a polymer film coating. A fuser system typically supplies the heat to the toner. The fuser system may employ two rollers in nip relation through which the media sheet or transparency passes for fusing. Heat may be provided by a halogen lamp placed inside one or both of the rolls. Alternatively, the fuser may be a belt fuser employing a polyimide or metal belt wrapped over a ceramic or other low thermal capacity heater. The belt is typically pressed against a silicon-coated backup roll to form a nip.

Figure 1:
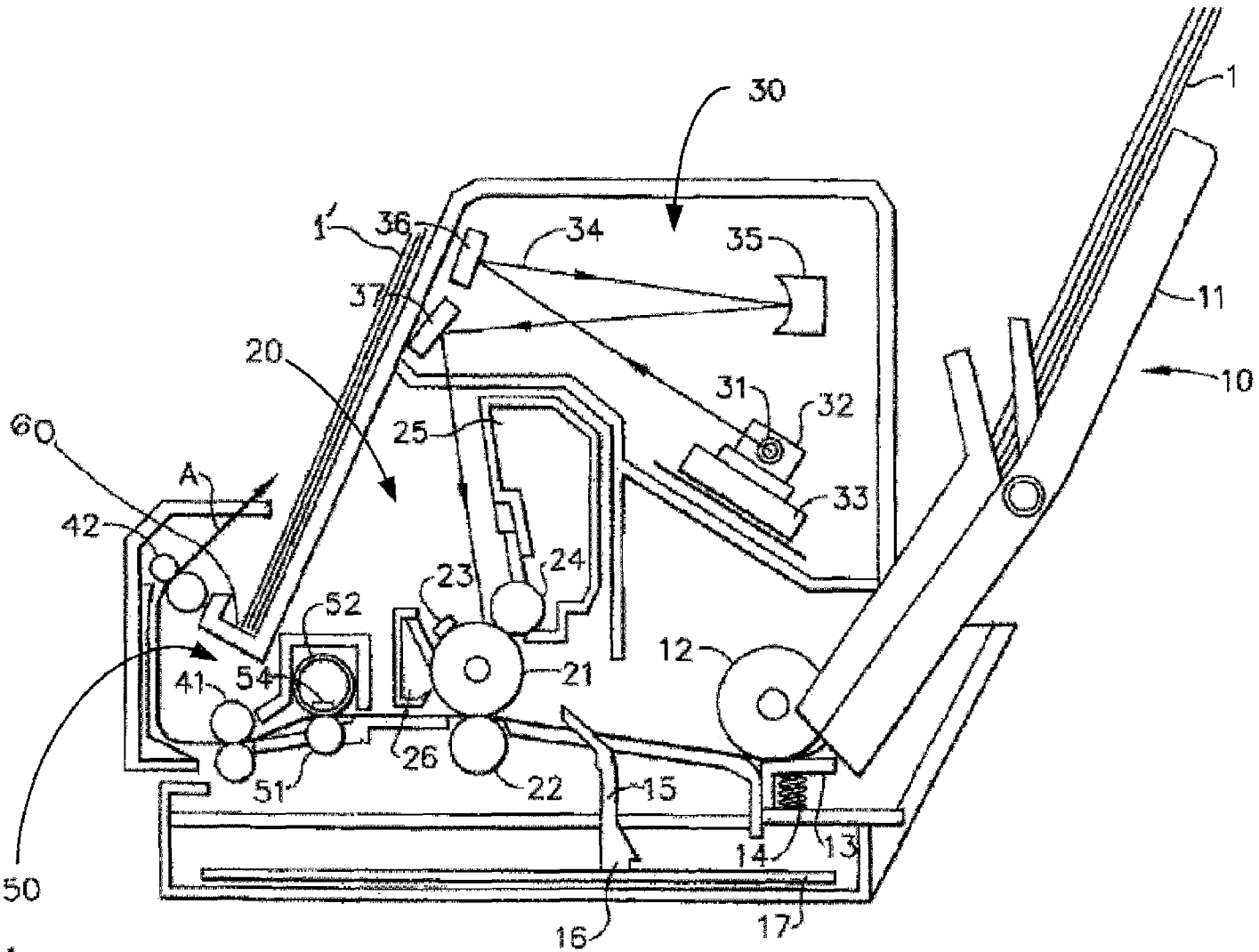
FIG.1 is illustrative of a printer or other imaging device in connection with the present invention.

A representative electrophotographic device, suitable for use in the present invention, is shown in FIG. 1. It includes a media feed section (10), an image-forming device (20), a laser scanning section (30), and a fixing device (50). The paper feed section (10), sequentially transports sheets of recording media (or other printing media) (1) to the image-forming device (20) provided in the printer. The image-forming device (20) transfers a toner image to the transported sheet of recording media (1). The fixing device (50) fixes toner to the sheet of recording media (1) sent from the image-forming device (20). Thereafter, the sheet of recording media (1) is ejected out of the printer by paper transport rollers (41, 42) and into the output bin (60) and shown at 1'. In short, the sheet of recording media (1) moves along the path denoted by the arrow (A) in FIG. 1.

The media feed section (10) includes a feed tray (11), a feed roller (12), a paper separating friction plate (13), a pressure spring (14), a media detection actuator (15), a media detection sensor (16), and a control circuit (17).

Upon receiving a print instruction, the sheets of recording media (1) placed in the media feed tray 11 (or in the case of the present invention, transparent resin sheets or any similar media with relatively high thermal capacitance as compared to paper) may be fed one-by-one into the printer by operation of the printer feed roller (12), the media separating friction plate (13) and the pressure spring (14). As the fed sheet of recording media (1) pushes down the media detection actuator (15), the media detection sensor (16) outputs an electrical signal instructing commencement of printing of the image. The control circuit (17), initiated by operation of the paper detection actuator (15) transmits an image signal to a laser diode light-emitting unit (31) of the laser scanning section (30) so as to control on/off of the light-emitting diode.

The laser scanning section (30) may include the laser diode light-emitting unit (31), a scanning mirror (32), a scanning mirror motor (33), and reflecting mirrors (35, 36 and 37). The scanning mirror (32) may be rotated at a constant high speed by the scanning mirror motor (33). In other words, laser light (34) scans in a vertical direction to the paper surface of FIG. 1. The laser light (34) radiated by the laser diode light-emitting unit (31) is reflected by the reflecting mirrors (35, 36 and 37) so as to be applied to the photosensitive body (21). When the laser light (34) is applied to the photosensitive body (21), the photosensitive body (21) is selectively exposed to the laser light (34) in accordance with on/off information from this control circuit (17).

The image-forming device (20) includes the photosensitive body (21), a transfer roller (22), a charging member (23), a developing roller (24), a developing unit (25), and a cleaning unit (26). The surface charge of the photosensitive body (21), charged in advance by the charging member (23), is selectively discharged by the laser light (34). An electrostatic latent image is thus formed on the surface of the photosensitive body (21). The electrostatic latent image is visualized by the developing roller (24), and the developing unit (25). Specifically, the toner supplied from the developing unit (25) is adhered to the electrostatic latent image on the photosensitive body (21) by the developing roller (24) so as to form the toner image.

Toner used for development is stored in the developing unit (25). The toner contains coloring components (such as carbon black for black toner) and thermoplastic components. The toner, charged by being appropriately stirred in the developing unit (25), adheres to the above-mentioned electrostatic latent image by an interaction of the developing bias voltage applied to the developing roller (24) and an electric field generated by the surface potential of the photosensitive body (21), and thus conforms to the latent image, forming a visual image on the photosensitive body (21). The toner typically has a negative charge when it is applied to the latent image, forming the visual image.

Next, the sheet of recording media (1) transported from the feed section (10) is transported downstream while being pinched by the photosensitive body (21) and the transfer roller (22). The media (1) arrives at the transfer nip in timed coordination with the toned image on the photosensitive body (21). As the sheet of recording media (1) is transported downstream, the toner image formed on the photosensitive body (21) is electrically attracted and transferred to the sheet of recording media (1) by an interaction with the electrostatic field generated by the transfer voltage applied to the transfer roller (22). Any toner that still remains on the photosensitive body (21), not having been transferred to the sheet of recording media (1), is collected by the cleaning unit (26).

Thereafter, the sheet of recording media (1) is transported to the fixing device (50). In the fixing device (50), an appropriate temperature and pressure are applied while the sheet of recording media (1) is being pinched by moving through the nip formed by a pressure roller (51) and the fixing roller or belt (52) that is maintained at an elevated temperature. The thermoplastic components of the toner are melted by the fixing roller (52) and fixed to the sheet of recording media (1) to form a stable image. The sheet of recording media (1) is then transported and ejected out of the printer by the printer transport rollers (41, 42) and into the output bin (60) where it may be stacked, one sheet (referenced as 1') of media upon another.

The fixing belt on the fixing roller is generally an endless belt or tube formed from a low thermal mass and durable material having good parting properties and preferably a thickness of not more than about 100 μm, more preferably not more than about 70 μm. Preferred belts are made from a polyimide film. The belt may have an outer coating of, for example, a fluororesin or Teflon® material to optimize release properties of the fixed toner from the belt. Such fuser belts are well-known in the art.

A heater (54), generally a ceramic heater, is placed on the inside surface of the belt and the outside surface of the belt forms a fusing nip with the back-up roller (51) at the location of the heater. Put another way, the heater (54) and the back-up roller (51) form the nip, with the fuser belt (52) interposed between them. Each sheet carrying the toner travels through this nip [i.e., between the fuser belt (52) and the back-up roller (51)] and the toner is fixed on the sheet through the combination of applied heat, the time the page is in the fuser nip, and pressure. Typically, the pressure between the fuser belt (52) and the back-up roller (51) at the fuser nip is from about 5 to about 30 psi. While the fuser belt (52) may be driven itself, often this is not the case. Generally, the back-up roller (51) is rotated and it is the friction between the surface of the back-up roller (51), and the printed sheet and ultimately the surface of the fuser belt (52), which causes the fuser belt (52) to rotate.

The backup or pressure roller (51) is generally cylindrical in shape. It is made from or is coated with a material that has good release and transport properties for the recording media (1). The backup roller (51) is sufficiently soft so as to allow it to be rotated against the fuser belt (52) to form a nip through which the printed sheets travel. By going through this nip, printed sheets are placed under pressure and the combined effects of this pressure, the time the sheet is in the nip, and the heat from the fuser belt (52) acts to fix the toner onto the media. A preferred material for use in forming the backup roller (51) is silicone rubber. The roller typically has an aluminum core with a silicone rubber layer molded or adhesively bonded onto its surface. This roller may also have a fluoropolymer (e.g., Teflon®) sleeve or coating. The backup roller may be essentially hollow, having a metallic core, an outer metallic shell surrounding and essentially concentric with the core, and ribs between the core and the outer shell.

With heat from the fuser system heater (54) being transferred to each sheet of media, as successive copies are printed, the sheets of media (1') stack up in the output bin 60 and the heat of fusing is accumulated. With two or more sheets stacked together, where such sheets have relatively high thermal capacitance, the toner may become sticky, or begin to remelt, and may transfer, at least partially, to an overlying sheet in the stack. The result is often reduced quality of the printed image as a residual image (offset) may be formed on the backside of the overlying sheet and corresponding toner "voids" created in the printed image of the underlying sheet in the stack. The present invention addresses such accumulation of heat and potential for offset as noted above, by identifying and controlling one or more of the process parameters which cause such problem to occur.

Figure 2A:
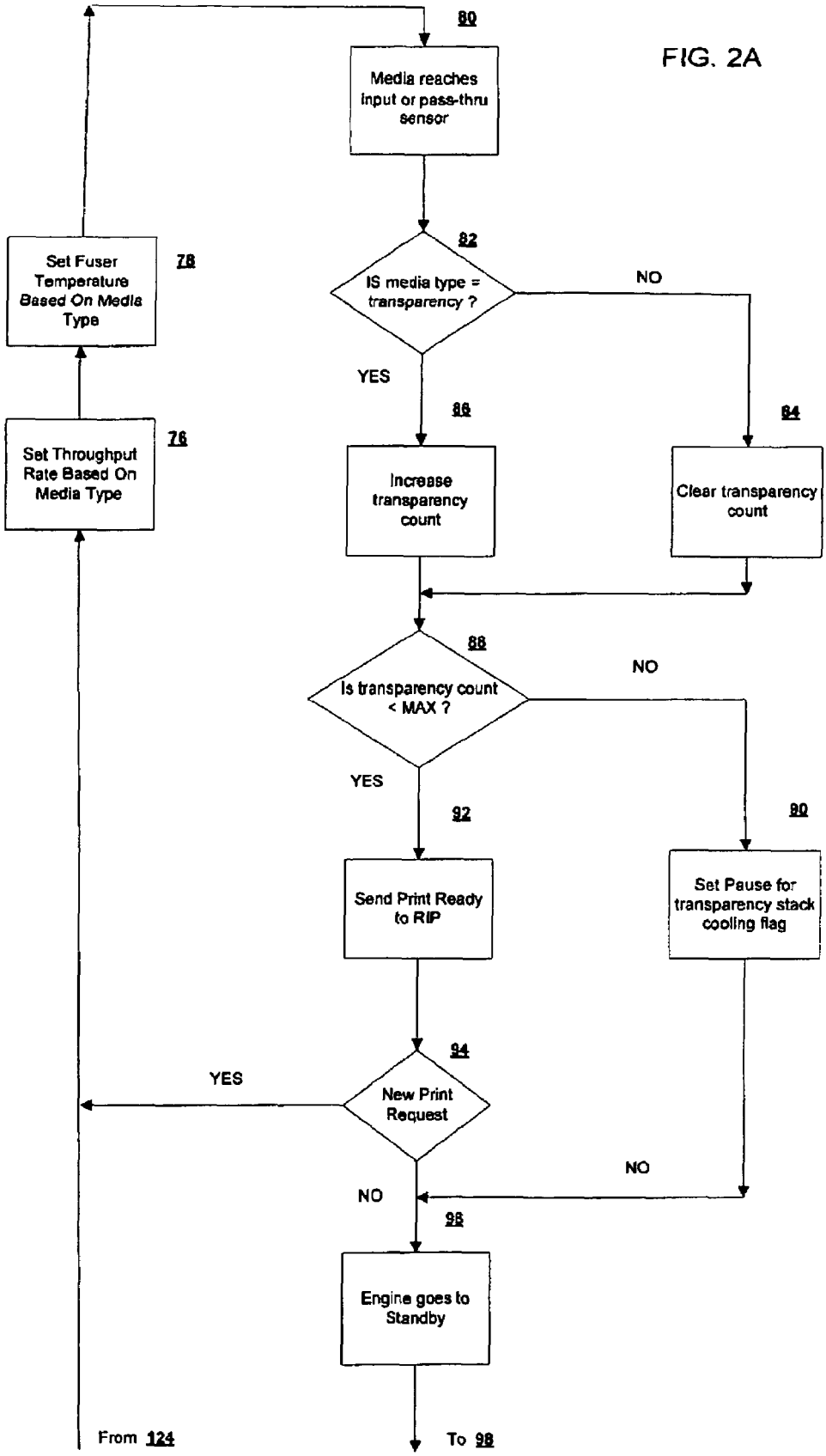
FIG. 2A-2C illustrate a detailed flow chart of the operation of the present invention.
Figure 2B:
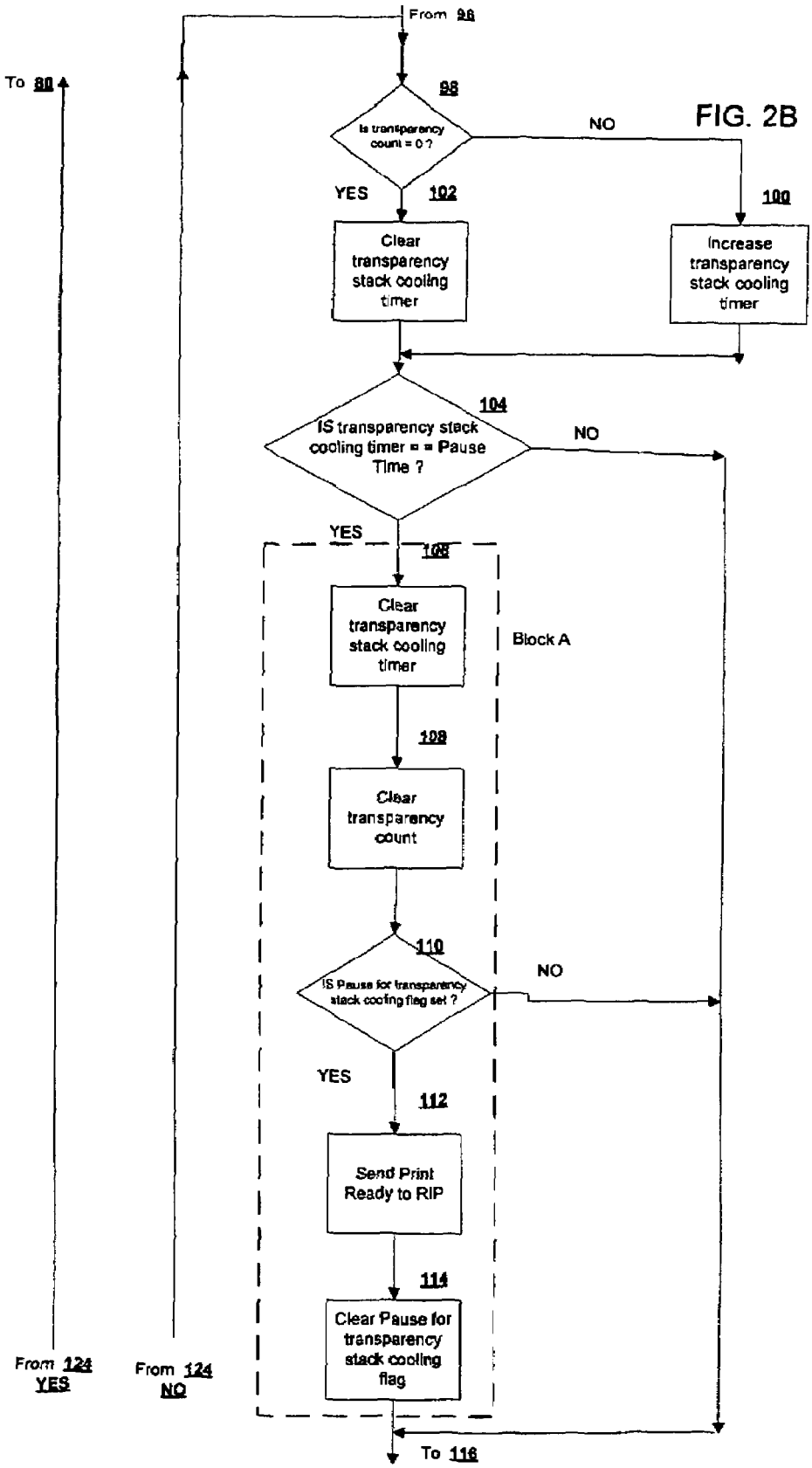
Figure 2C:
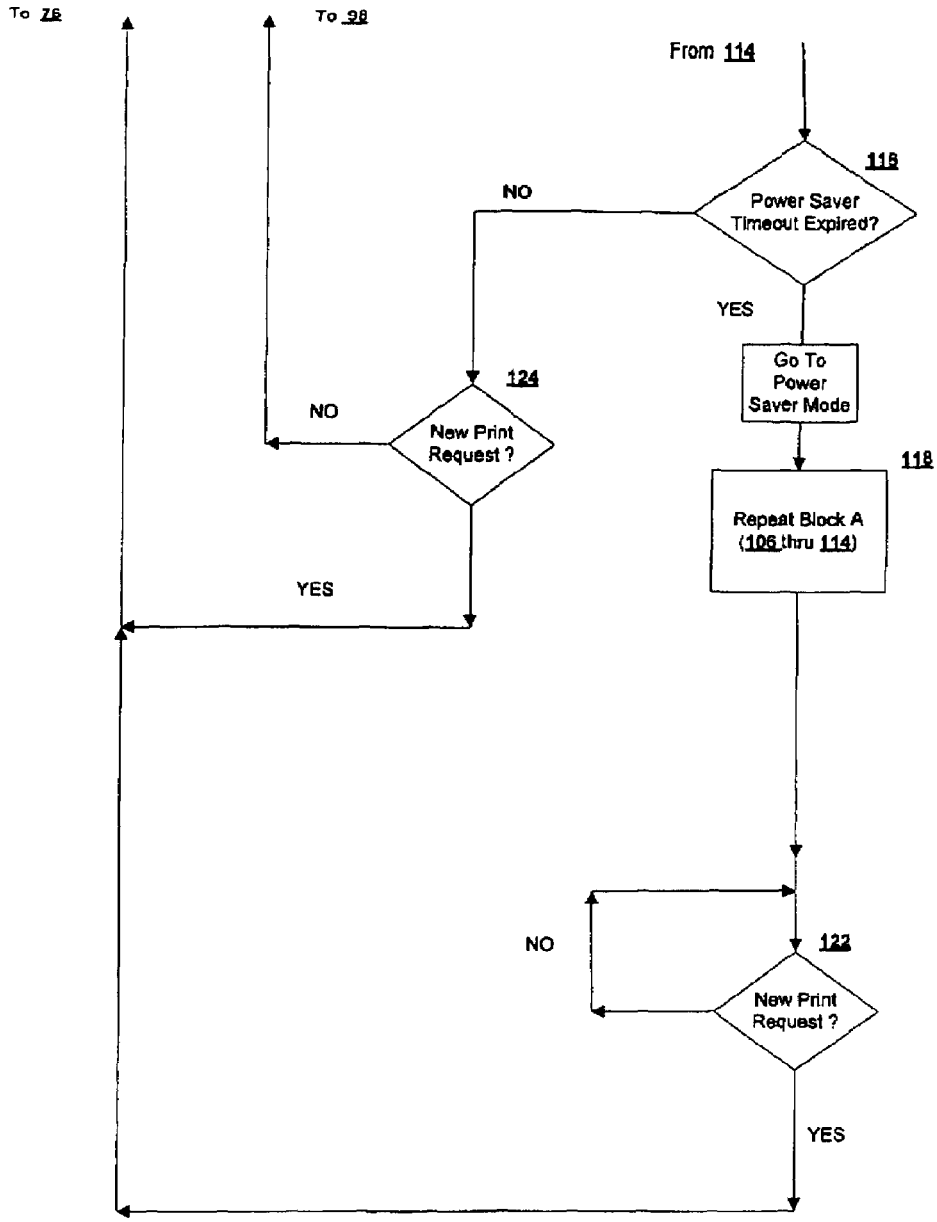

A preferred embodiment of the present invention is illustrated in the flow chart given in FIG. 2A-2C. The present invention solves, among other things, the problem of accumulation of too much heat in the printer output bin 60 by recognizing that when a relatively high thermal capacitance media, e.g., a transparency, is to be printed upon, one can, e.g., reduce the fuser temperature and/or reduce the process speed, while still maintaining acceptable print quality (e.g., toner fusion). In connection with the particular variable of reducing the process speed, it can be appreciated herein that such may be accomplished by preferably tracking the number of transparencies that have been printed over a given period and regulating the through-put rate so that the stack of transparencies produced have an adequate time to cool to avoid the offsetting problems noted above.

Accordingly, in the broad context of the present invention, it has been found that transparencies with toner will stick to one another when above a certain temperature threshold limit when stacked in the output bin of a printer or copier. It has been found that, e.g., stacked transparencies, made from polyester, polyamide, ionomer or other resins, with toner which are at or above a temperature of about 100-105° C., will tend to attach to one another when removed from the output bin due to sticking of the toner between transparency sheets. Therefore, in a particularly prefened embodiment, the present invention recognizes that for toner that has a melting temperature Tm (toner), the temperature of the transparencies in the output bin may be regulated such that they avoid approaching within about 10-15° C. of a toner thermal softening transition, such as Tm (toner) and/or exceeding Tm (toner). The Tm of toner may be about 100-110° C.

Exemplary system operation in accordance with the present invention, as shown in FIG. 2A, starts with action 76, wherein the system first sets a throughput rate based on media type and at 78 sets the fuser temperature based on media type. Along such lines it can be noted that plain paper may typically run at 6.9"/sec for 32 ppm (pages per-minute) with the fuser temperature set to 215° C. For transparencies, the speed is initially adjusted downward, and in a representative embodiment to about 3.45"/sec for 16 ppm, and the fuser temperature is reduced to about 160° C. At 80, the media then reaches the input or pass-through sensor 16.

To initiate printing, the printer controller determines at decision point 82 whether the media type is a transparency or other media (paper, etc.). In the broad context of the present invention, the detection of whether the media may be a transparency can be accomplished by manually inputting such information to the printer or copier, and/or providing an automatic detection means to determine whether or not the media is, e.g., a paper or plastic transparency.

If the decision is no, that the media is not a transparency, the controller at action 84 clears the transparency counter. If the decision is yes, that the media is indeed a transparency, the controller at action 86 increases the transparency count by one unit. At 88 the system then monitors whether or not the transparency count is less than a selected maximum amount that was determined to provide a heat build-up in the output bin for a given printer or copier output bin. In such regard, it has been found that offset and sticking of toner on stacked transparencies may occur in certain printers when only as few as 2-3 transparencies are stacked in the output bin after printing at a rated speed.

Figure 3:
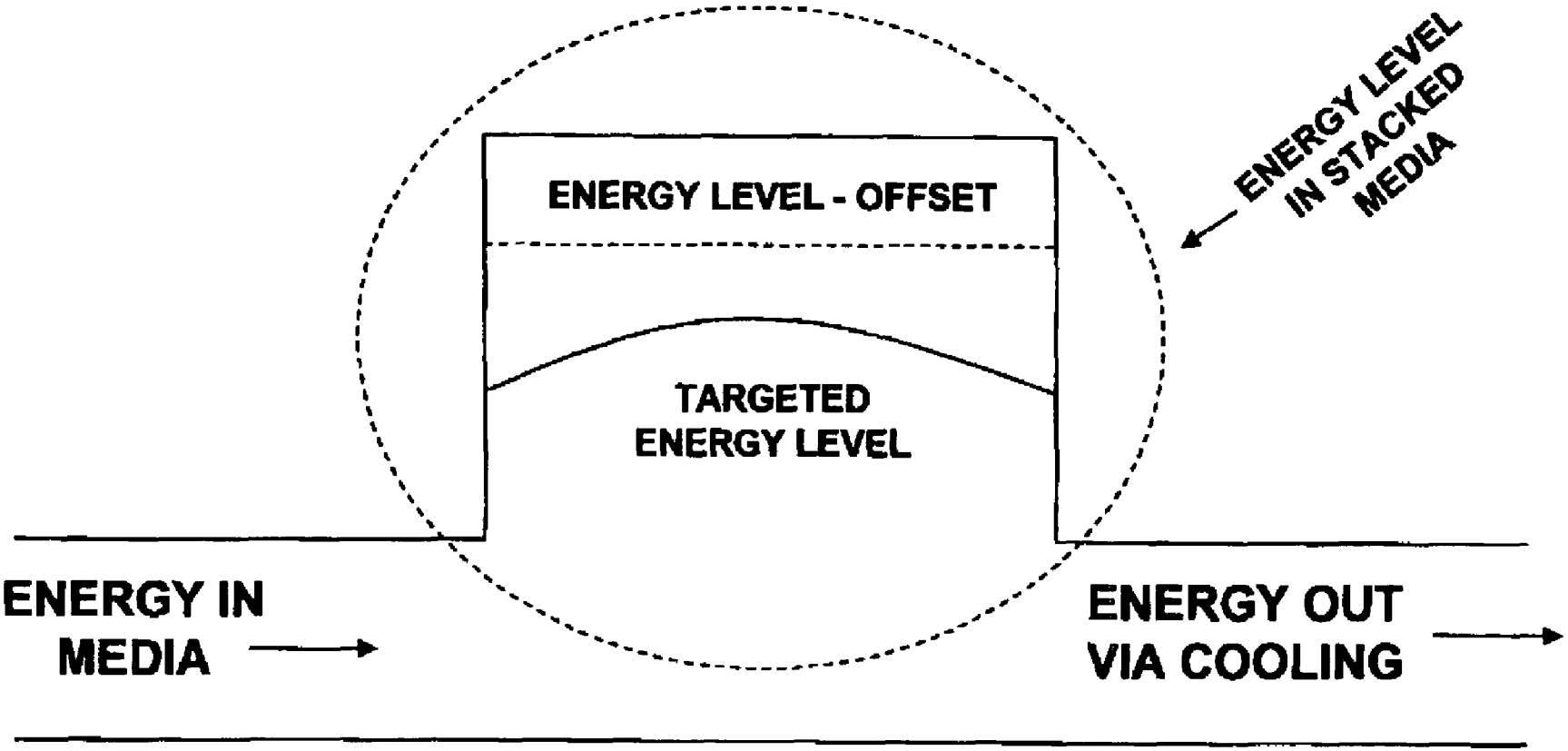
FIG. 3 illustrates the factors that contribute to energy build-up and energy-out of the cooling stack in a printer or copier.

In such regard, attention is directed to FIG. 3 which generally illustrates how energy build-up in media typically occurs in stacked media in printers or copiers. As illustrated, energy in media due to the printing or copying operation, and particularly in the case of media with relatively high thermal capacitance such as a transparency, can accumulate when stacked. Accordingly, the energy level of the stacked media can exceed the energy level where toner on the media may soften and cause an offset as between stacked sheets. As illustrated, in the present invention, one can identify a targeted energy level at which offset may be substantially avoided. In that sense, and as illustrated, energy level build-up in the stacked media may be greater at those locations towards the center of the media, as opposed to the edges of the media, and it is therefore preferable to consider the energy or heat build-up at such location in the stacked media where the media may actually be self-insulating. Accordingly, in the broad context of the present invention, a temperature measurement can optionally be made at a selected location or locations within the stacked media, or at a suitable location or locations proximate to said stacked media, which temperature measurement may optionally be monitored by the device to avoid exceeding a temperature or temperature profile in the stacked media where toner on the stacked sheets of media may transfer as between the sheets.

Returning then to FIG. 2A, at decision point 88, the printer controller compares the transparency count to a predetermined maximum value, which may be empirically established as corresponding to that amount of stacked media that leads to offset. In that context, it has been found that for a particular number of stacked transparencies, the offset phenomena is typically binary. In other words, once a particular number of transparencies are stacked, sticking will occur, and it is possible that such sticking can occur after only 2-3 sheets of transparency media are stacked, at a given fuser temperature and rated speed.

If the decision is that the count equals the predetermined maximum allowable count, then action 90 sets a pause for the transparency stack cooling flag. For instance, the device may then be rendered inoperable for about 30 seconds or other appropriate time period to allow the heat to dissipate from the stack. If the decision is yes, (that is the count is less)

then action 92 is to send a "print ready" to the raster image processor (RIP) and printing will proceed.

Expanding upon the above, it should be noted that in the case of the exemplary transparency printing rate of 16 pages per minute, the rate can be further reduced by one of several options to reduce such rate to, e.g., about 8 pages per minute, which would represent a reduction of 50%. For example, while the rate can be reduced by implementing a complete pause command to the system, it can be appreciated that the rate of transport of the media can itself be reduced, or optionally, the gap time (GT) between printing successive sheets of media can be increased. Accordingly, the rate of movement of media may be reduced 5-500%, and all incremental values therebetween, by any one or more of such optional procedures.

In the event that the number of transparencies is fewer than a predetermined maximum, the printer completes the printing of the transparencies while remaining under the predetermined maximum amount. Then, at decision 94 the printer controller determines whether there is a new print request, and if yes, the action is to repeat the above described process by again determining the type of media (action 76), etc.

Alternatively, as alluded to above, if the decision at 88 is no, and the system invokes a pause, the print engine goes to standby as indicated at 96. As shown in FIG. 2B, the process continues at decision 98, where the printer controller again determines whether the transparency counter is at zero. If the decision is again no (see action 100), the transparency stack cooling timer is increased, to provide more time for cooling by reducing the frequency at which transparencies are being printed. If the transparency counter has been reset to zero at 98 (in those situations where the stack cooling time has equaled the pause time which may occur at 104), then action 102 clears the transparency cooling timer.

At 104 the system checks whether the transparency stack cooling timer has indeed finally reached an appropriate pause time for the transparencies to cool so that printing may continue without offset. If the system has paused for a sufficient time to cool, the system will then clear the transparency stack cooling timer at 106, clear the transparency counter at 108, and check 110 the status for the presence of a pause on the transparency stack cooling flag. If yes, the system sends 112 a print ready to the RIP and clears 114 the pause for the transparency stack cooling flag and then checks whether the power saver timeout has expired as shown at 116. Alternatively, if no, the system directly checks whether the power saver timeout has expired, again at 116.

Turning then to 116, if the power saver timeout has expired, the system proceeds to power saver mode at 118 it repeats blocks 106-114 noted above followed by decision 122 as to whether to not there is a new print request. If no, the system keeps checking for the presence of a new print request. If there is a new print request, the system directs back up to set the throughput rate based on media type at 76, etc. Alternatively, if the power saver timeout has not expired, the system monitors for a new print request at 124, and if yes, proceeds back to 76, etc., and if no, proceeds to 98, etc.

In this manner, the device is controlled via the algorithm, as shown in FIG. 2A-2C, which provides printed transparencies under conditions which ensure good image quality are met and offset in stacked media is substantially avoided. All of the foregoing control actions and computations of FIG. 2A-2C may be accomplished by an electronic data processor, which typically is a microprocessor (or microprocessors; typically the RIP is done by a separate microprocessor).

Figure 4:
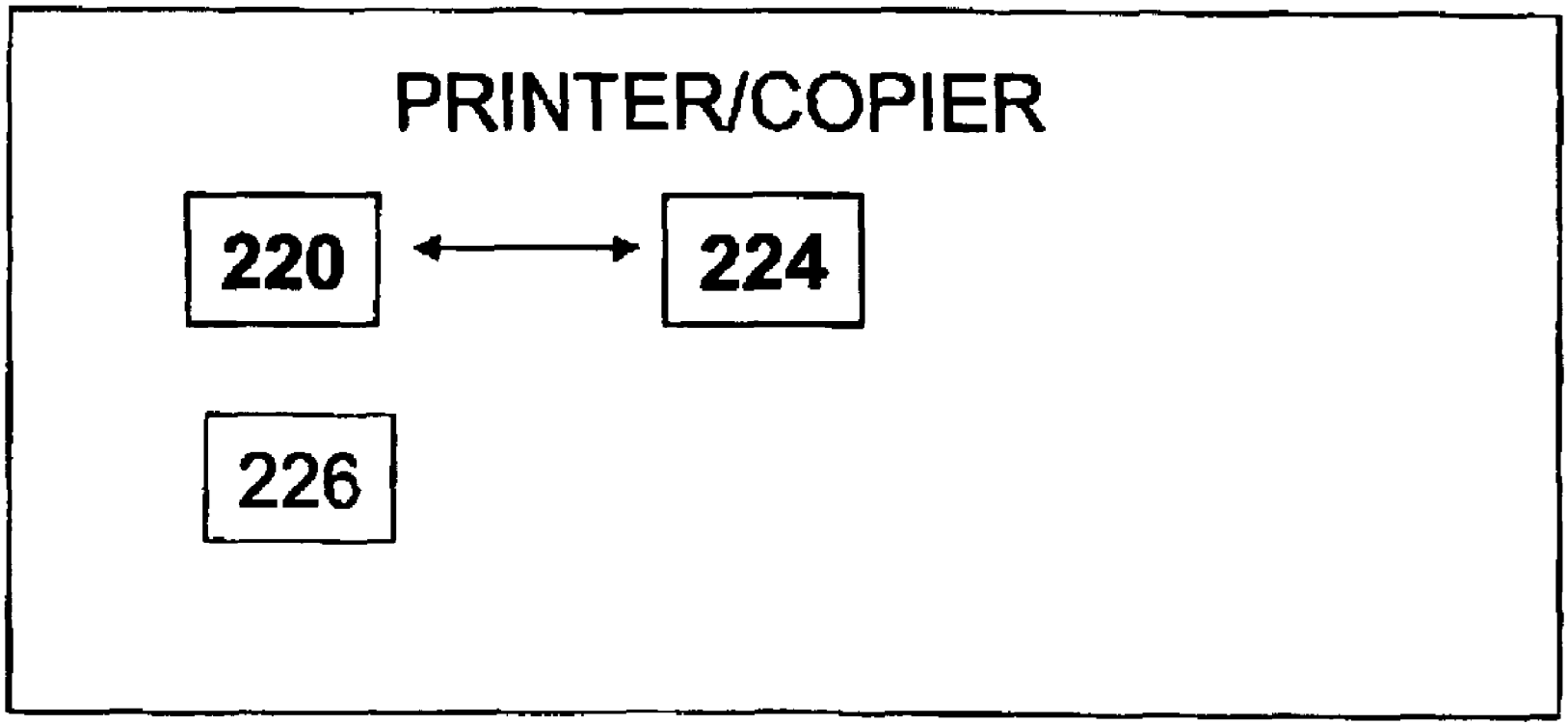
FIG. 4 illustrates a basic systems level diagram of the present invention.

It should also be appreciated that the functionality described herein for the embodiments of the present invention may be implemented by using hardware, software, or a combination of hardware and software, either within the printer or copier or outside the printer copier, as desired. If implemented by software, a processor and a machine readable medium are required. The processor may be of any type of processor capable of providing the speed and functionality required by the embodiments of the invention. Machine-readable memory include any media capable of storing instructions adapted to be executed by a processor. Some examples of such memory include, but are not limited to, read-only memory (ROM), random-access memory (RAM), programmable ROM (PROM), erasable programmable ROM (EPROM), electronically erasable programmable ROM (EEPROM), dynamic RAM (DRAM), magnetic disk (e.g., floppy disk and hard drive), optical disk (e.g. CD-ROM), and any other device that can store digital information. The instructions may be stored on medium in either a compressed and/or encrypted format. Accordingly, in the broad context of the present invention, and with attention to FIG. 4, the printer or copier may contain a processor 220 and machine readable media 224 and user interface 226.

It will be appreciated that any specific values given herein are illustrative with regard to the limits of this invention. As those of skill in the art will appreciate, operation involves interaction of, e.g., heating and cooling of media which may vary in characteristics, and final values may be readily obtained experimentally and may vary depending on all the physical factors of a particular printing or copying device. The illustrations shown in the present application are therefore only intended to be illustrative of the present invention and not limiting thereof. The full scope of the present invention is defined by the following claims and equivalents thereof.

What is claimed is:

1. A method of controlling the accumulation of heat in stacked sheets of media in a printing or copying device, said device having a collection location for collection of a plurality of media sheets, wherein the sheets of media include toner images, and a fixing device to fix said toner images on said media at a selected temperature, comprising the steps of providing in said printing or copying device a control system wherein said control system:

identifies media for printing or copying at a selected fuser temperature and adjusts said fuser temperature for selected media based upon media thermal capacitance, wherein said selected fuser temperature is set lower for media having a relatively higher thermal capacitance;

clears or accumulates a count of sheets of media based on the media thermal capacitance, wherein if said media has a relatively lower thermal capacitance said count of sheets is cleared and if said media has a relatively higher thermal capacitance said count of sheets is incremented;

identifies a maximum media sheet count for media having a relatively higher thermal capacitance and increases the time interval between sheets of media reaching the fixing device when said count of sheets having a relatively higher thermal capacitance equals said maximum media sheet count for media having a relatively higher thermal capacitance; and clears or increments a cooling timer based on the media thermal capacitance.

2. The method of claim 1 wherein said control system assigns a rate of movement of media in said printing or copying device for selected media such that the accumulation of heat in a plurality of sheets of said media is controlled not to exceed a condition where said toner on said plurality of sheets of media at the collection location will transfer as between said sheets.

3. The method of claim 2 wherein said control system reduces the rate of movement in said printing or copying device by pausing the printing or copying device from printing or copying.

4. The method of claim 2 wherein said rate of movement of said media is reduced 5-500% relative to said set throughput rate.

5. The method of claim 1 wherein said the count of sheets of media is a consecutive count.

6. The method of claim 1 wherein said media comprises transparent media.

7. The method of claim 6 wherein said transparent media comprises polyester, polyamide or an ionomer resin.

8. The method of claim 1 wherein said media comprises a plastic or paper label with a polymer film coating.

9. The method of claim 1 wherein said collection location is an output bin.

10. The method of claim 1 wherein said control system adjusts said fuser temperature to a lower fuser temperature.

11. A system for controlling the accumulation of heat in a plurality of sheets of media in a printing or copying device, wherein the sheets of media include toner images, and a fixing device to fix said toner images on said media at a selected temperature, said device having a collection location for collection of one or a plurality of media sheets, comprising:

a controller which is capable of maintaining a sheet count, setting a throughput rate and fuser temperature for said media based upon media thermal capacitance, wherein said fuser temperature is set lower for media having a relatively higher thermal capacitance and resets said sheet count for media having a relatively lower thermal capacitance, and which controller identifies a maximum sheet count for said media;

said controller capable of identifying whether or not said printer or copying device has output a number of media sheets equal to said maximum media sheet count, at which point said controller is capable of assigning a rate of movement of media in said printing or copying device for selected media such that the accumulation of heat in a plurality of sheets of said media at said collection location is controlled not to exceed a condition where said toner will substantially transfer as between said sheets, wherein said controller is capable of reducing the rate of movement of said media in said printer or copier by pausing the printing or copying device from printing or copying; and wherein said controller is capable of clearing or incrementing a cooling timer based on said media thermal capacitance.

12. The system of claim 11 wherein said controller is capable of pausing the number of media sheets reaching said collection location for a selected time and upon pausing for said selected time allows additional media to collect in said collection location.

* * * * *